US006441796B1

(12) United States Patent
Schadler

(10) Patent No.: US 6,441,796 B1
(45) Date of Patent: Aug. 27, 2002

(54) HIGH POWER QUADRAPOLE FM RING ANTENNA FOR BROADBAND MULTIPLEXING

(75) Inventor: John L. Schadler, Raymond, ME (US)

(73) Assignee: SPX Corporation, Charlotte, NC (US)

( * ) Notice: Subject to any disclaimer, the term of this patent is extended or adjusted under 35 U.S.C. 154(b) by 0 days.

(21) Appl. No.: 09/873,210

(22) Filed: Jun. 5, 2001

(51) Int. Cl.[7] ..... H01Q 1/12
(52) U.S. Cl. ..... 343/803; 343/793
(58) Field of Search ..... 343/803, 797, 343/799, 810, 891, 798

(56) References Cited

U.S. PATENT DOCUMENTS 2,512,137 A * 6/1950 Buchwalter et al. ..... 250/33
3,388,400 A * 6/1968 Veldhuis ..... 343/822
5,534,882 A * 7/1996 Lopez ..... 343/891

* cited by examiner

*Primary Examiner*—Don Wong
*Assistant Examiner*—James Clinger
(74) *Attorney, Agent, or Firm*—Baker & Hostetler, LLP

(57) ABSTRACT

An antenna for broadband multiplexing is disclosed. The antenna includes a first set of curved dipole members and a second set of curved dipole members arranged in a helical shape. One set of the dipole members is set with approximately 36° between each dipole member in the set. The other set of dipole members is set with approximately 27.5° between each dipole member in the set. The setting of the dipole members at the designated angles increases the bandwidth that the antenna can accommodate.

22 Claims, 6 Drawing Sheets

HIGH POWER QUADRAPOLE FM RING ANTENNA FOR BROADBAND MULTIPLEXING

FIELD OF INVENTION

The present invention relates generally to transmitting analog signals. More particularly, the present invention relates to an apparatus for broadband multiplexing of FM signals.

BACKGROUND OF INVENTION

Recently, the rules regarding ownership of FM Broadcast Stations have been relaxed. Consequently, the FM broadcast industry has changed. In particular, FM broadcast stations have been driven to share transmission facilities. By sharing a single antenna and transmission line, the station owners can individually reduce their costs. However, the amount saved by a station owner will be dependent upon the cost of the overall transmission facility.

Typically, Master FM antenna systems are used to consolidate radio frequency (RF) transmission facilities. A Master antenna system may be either a large master antenna system or a small master system. A large master antenna system is more costly than a small master antenna system, and generally utilizes a panel antenna, nine-inch rigid coaxial line, and constant impedance combiner modules. The above configuration for a large master antenna system typically gives the large master antenna system the capability to support ten (10) stations across the entire FM band. In addition to being able to accommodate a wide bandwidth, a typical large master antenna system is also able to deliver high power, and maintain a constant antenna pattern (i.e., radiation pattern). The primary disadvantage of the large master antenna system is its high cost.

A small master antenna system, which is less than a large master antenna system, typically is a side-mounted antenna. Generally, small master antenna systems are capable of accommodating up to three stations. Further, small master antenna systems usually can only accommodate about 5 MHz of bandwidth. Further, the antenna pattern of the FM signal being transmitted may not be constant at all frequencies. Although the small master antenna system is less expensive than the large master antenna system, it does not have the capabilities of the large master antenna system, or perform as well as the large master antenna system. Thus, there is a significant difference, in performance abilities and cost, between the large and small master antenna systems.

An approach to the disparity between the large and small antenna systems was the development of a master antenna system that accommodates up to four FM stations, particularly, Class C stations, over a bandwidth of 13 MHz. Class C stations are authorized to broadcast with a maximum Effective Radiated Power (ERP) of 100 KW, which is the highest power license for FM in the U.S. A design for this master antenna system may include up to sixteen (16) sections of circularized polarized elements in stacked arrays. Typically, a branch feed system is employed for accommodating 12 MHz of bandwidth for a master antenna of this type. The branch feed system will deliver a signal to a feedpoint mouth of the antenna, which is typically 1.5 inches in diameter. The circularly polarized elements, usually consisting of curved dipole members, are arranged in a shape of a helical spiral. Thus, the distance between the curved dipole members remains constant throughout the spiraling shape. Typically, the overall diameter of the helix is 36 inches.

Although, this master antenna system was developed as an alternative to the large and small antenna systems, which have been traditionally used to multiplex FM stations, it suffers in performance when attempts are made to multiplex more than four stations. Further, it suffers when more than 12 MHz of bandwidth is needed.

Accordingly, it is desirable to provide an antenna system designed for broadband multiplexing of FM stations that is capable of accommodating more than four stations across 12 MHz of bandwidth or more, and maintaining excellent performance. Further, it is desirable to provide an antenna system that is able to sustain the power of more than four stations.

SUMMARY OF THE INVENTION

The foregoing desired result has been achieved to a great extent by the present invention, which, in one aspect, an antenna system is provided having a first and a second curved dipole member. The first and second dipole member are affixed to opposite ends of a first connecting member wherein said first dipole members form straight lines between their terminal ends when viewed along the axis of the first connecting member. A third and fourth curved dipole member are also provided. The second and third dipole member are affixed to opposite ends of as second connecting member wherein the third and fourth dipole members form straight lines between their terminal ends when viewed along the axis of the second connecting member. The second connecting member intersects said first connecting member, and there is a 36° angle between the straight line formed by said first and second curved dipole members and the second connecting member and a 27.5° angle between the straight line formed by the third and fourth curved dipole members and the axis of the first connecting member.

In another aspect of the invention, a method of broadcasting a radio frequency signal is provided having the steps of transmitting a radio frequency signal to a quadrapole ring antenna and radiating the radio frequency signal from the antenna. In this method, the quadrapole ring antenna has a first and second dipole member affixed at opposite ends of a first connecting member and wherein the first and second dipole members form straight lines between their terminal ends when viewed along the axis of the first connecting member and wherein there is less than a 36° angle between the straight line formed by the first and second dipole member and a plane normal to the first connecting member.

In the foregoing method, the quadrapole ring antenna can also have a third and a fourth dipole member affixed at opposite ends of a second connecting member and wherein the third and fourth dipole members form straight lines between their terminal ends when viewed along the axis of the second connecting member and wherein there is a 327.5° angle between the straight line formed by said third and fourth dipole member and a plane normal to the second connecting member.

There has thus been outlined, rather broadly, the more important features of the invention in order that the detailed description thereof that follows may be better understood, and in order that the present contribution to the art may be better appreciated. There are, of course, additional features of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION OF PREFERRED EMBODIMENTS OF THE INVENTION

A preferred embodiment of the present invention provides an antenna for multiplexing signals, and in particular, for multiplexing up to, and including, nine (9) FM broadband stations.

Figure 1:
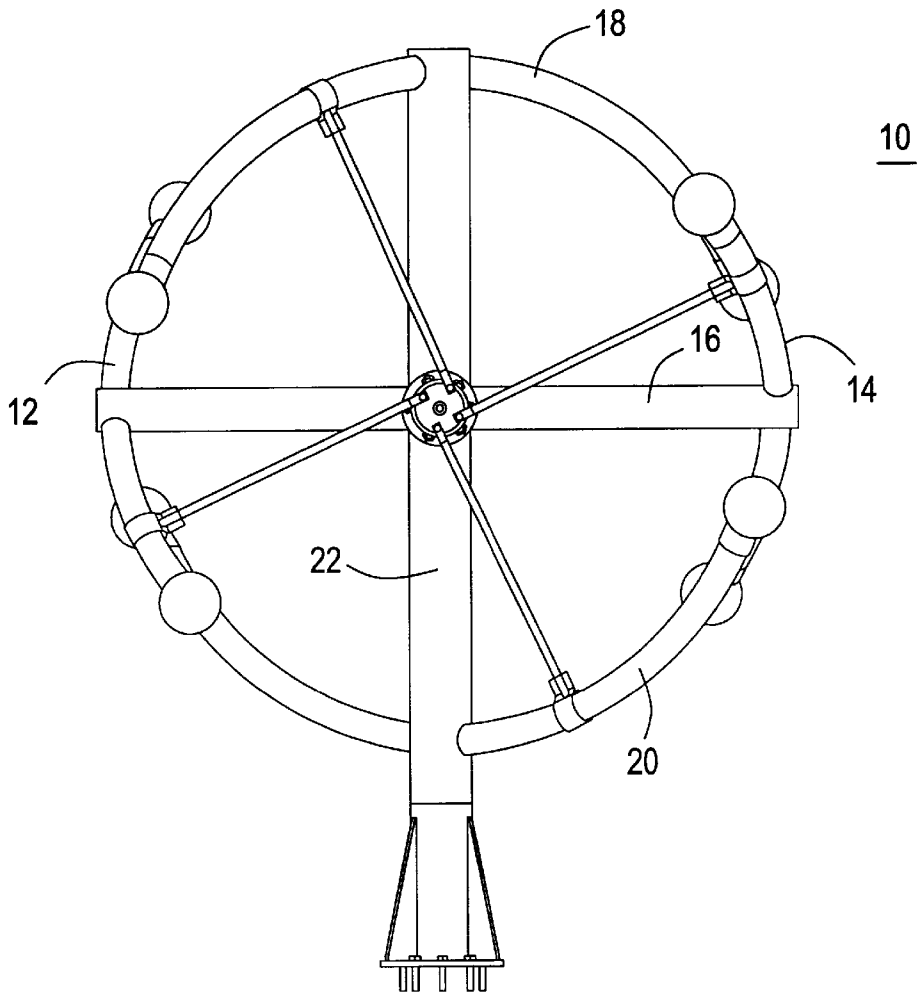
FIG. 1 is a top view of an antenna in accordance with a preferred embodiment of the present invention.

Referring now to FIG. 1 of the figures, wherein like reference numerals indicate like elements, there is a preferred embodiment of a quadrapole FM ring antenna, according to the present invention. As shown in FIG. 1, the quadrapole FM ring antenna 10 includes a first curved dipole member 12 connected to a second curved dipole member 14 by a first axial connecting member 16. The quadrapole FM ring antenna 10 also includes a third curved dipole member 18 connected to a fourth curved dipole member 20 by a second axial connecting member 22.

Figure 2:
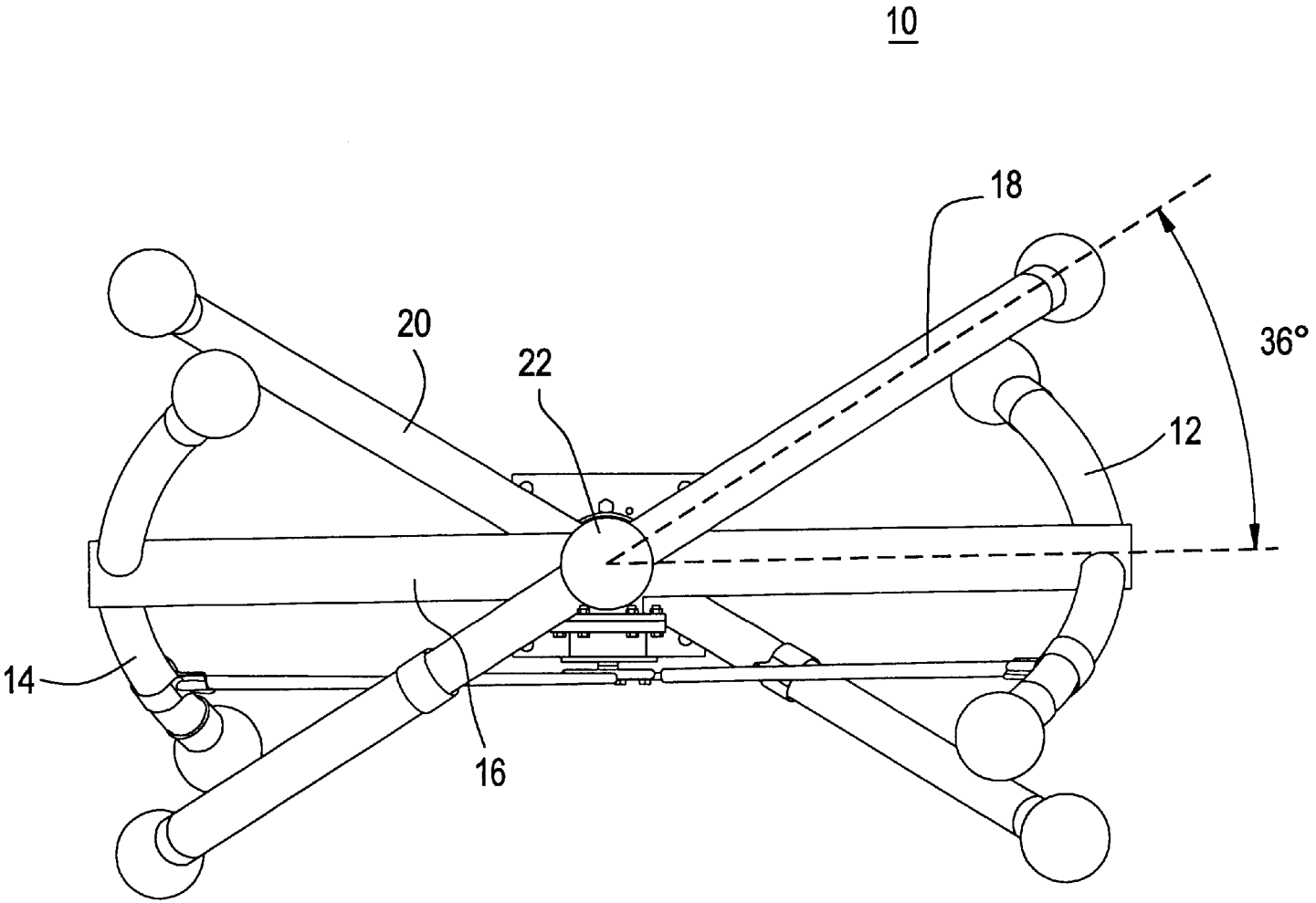
FIG. 2 is a front view of an antenna in accordance with an exemplary embodiment of the present invention.
Figure 3:
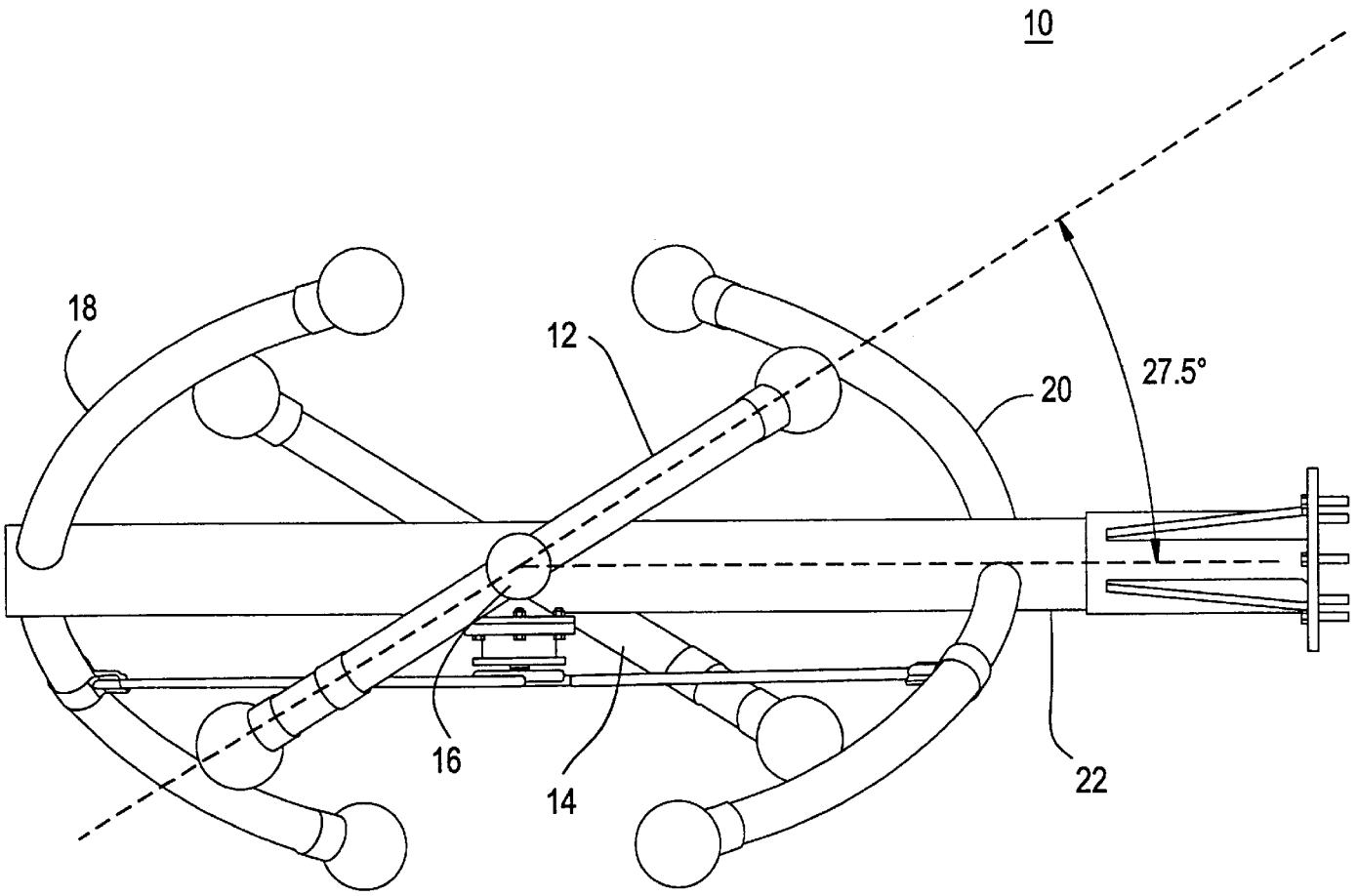
FIG. 3 is a side view of an antenna in accordance with an exemplary embodiment of the present invention.

As shown in FIG. 2, the first and third curved dipole members form a set of curved dipole members that are not axially connected. When viewed along the axis formed by the second axial connecting member 22, the third dipole arm 18 forms a straight line between its terminal ends. As shown in FIG. 2, there is a 36° angle between the straight line taken through the center of the third curved dipole member 18, when viewed along the axis of the second connecting member 22, and the axis of the first axial connecting member 16. Similarly, as shown in FIG. 3, when viewed along the axis formed by the first connecting member 16 the first dipole arm 12 forms a straight line between its terminal ends. In a preferred embodiment of an antenna, according to the present invention, as shown in FIG. 3, there is a 27.5° angle between the straight line taken through the center of said first curved dipole member 12 when viewed along the axis formed by the first connecting member 16 and the second axial connecting member 22.

Further, as shown in FIG. 2 the second curved dipole member and the fourth curved dipole member are also not axially connected. When viewed along the axis formed by the second axial connecting member 22, the fourth dipole arm 20 forms a straight line between its terminal ends. As shown in FIG. 2, there is a 36° angle between the straight line taken through the center of the fourth curved dipole member 20, when viewed along the axis of the second connecting member 22, and the axis of the first axial connecting member 16. Similarly, as shown in FIG. 3, when viewed along the axis formed by the first connecting member 16 the second dipole arm 14 forms a straight line between its terminal ends. In a preferred embodiment of an antenna, according to the present invention, as shown in FIG. 3, there is a 27.5° angle between the straight line taken through the center of said second curved dipole member 14 when viewed along the axis formed by the first connecting member 16 and the second axial connecting member 22.

Figure 4:
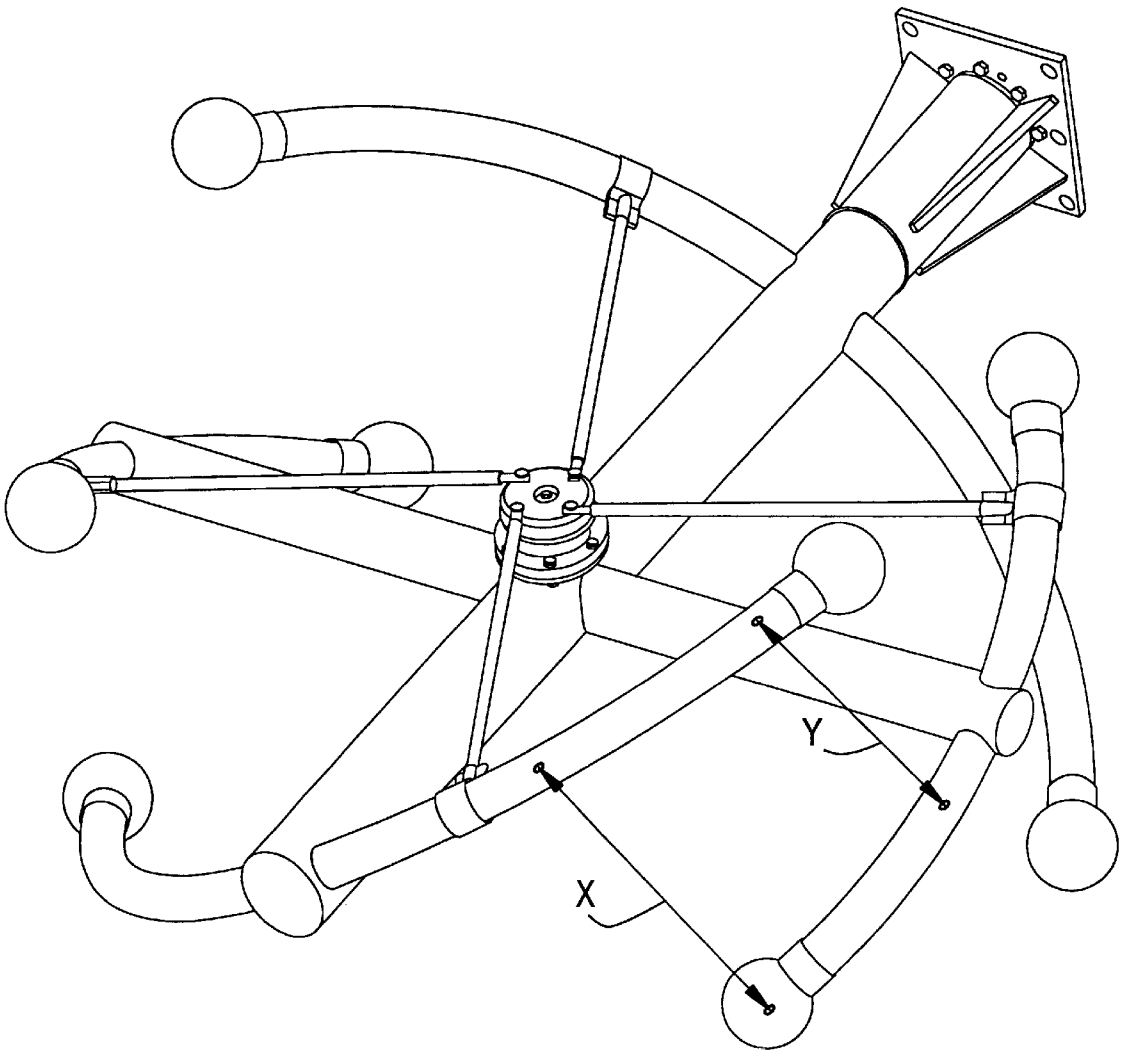
FIG. 4 illustrates the arrangement of several elements of an antenna in accordance with an exemplary embodiment of the present invention.

By setting the two sets of dipole members to 36° and 27.5°, respectively, the impedance bandwidth is improved without affecting the circularity of the azimuth patterns. Further, by using dipole members distributed along a straight line, when viewed along the axis of the connecting members, and rocked to the given angles, a non-constant gap is created between the dipole members, as illustrated by X and Y in FIG. 4. The gap is non-constant because the distance X is not equal to the distance Y. Accordingly, the assembly of the curved dipole members do not form a true helix. Having a non-constant gap between the dipole members increases the bandwidth capabilities of the quadrapole FM ring antenna, according to the present invention. The angles described above and herein are set to optimize the antenna's vertical polarization. However, the angles between the curved dipole members, according to the present invention, may be set to different values which still enable the operation of the antenna. In a preferred embodiment, the angles between said curved dipole members are set to produce equal amounts of vertical and horizontal polarization. As shown in FIG. 1, the four curved dipole members are arranged in a helical shape. Ideally, the diameter of the helix is approximately 45 inches. This diameter is greater than the helix diameter of the common ring style antenna, and as a result, the "Q" is reduced, and the quadrapole FM ring antenna is able to achieve broader bandwidth in both the impedance characteristics and the polarization ratio stability, than previously achieved in the related art.

Figure 5:
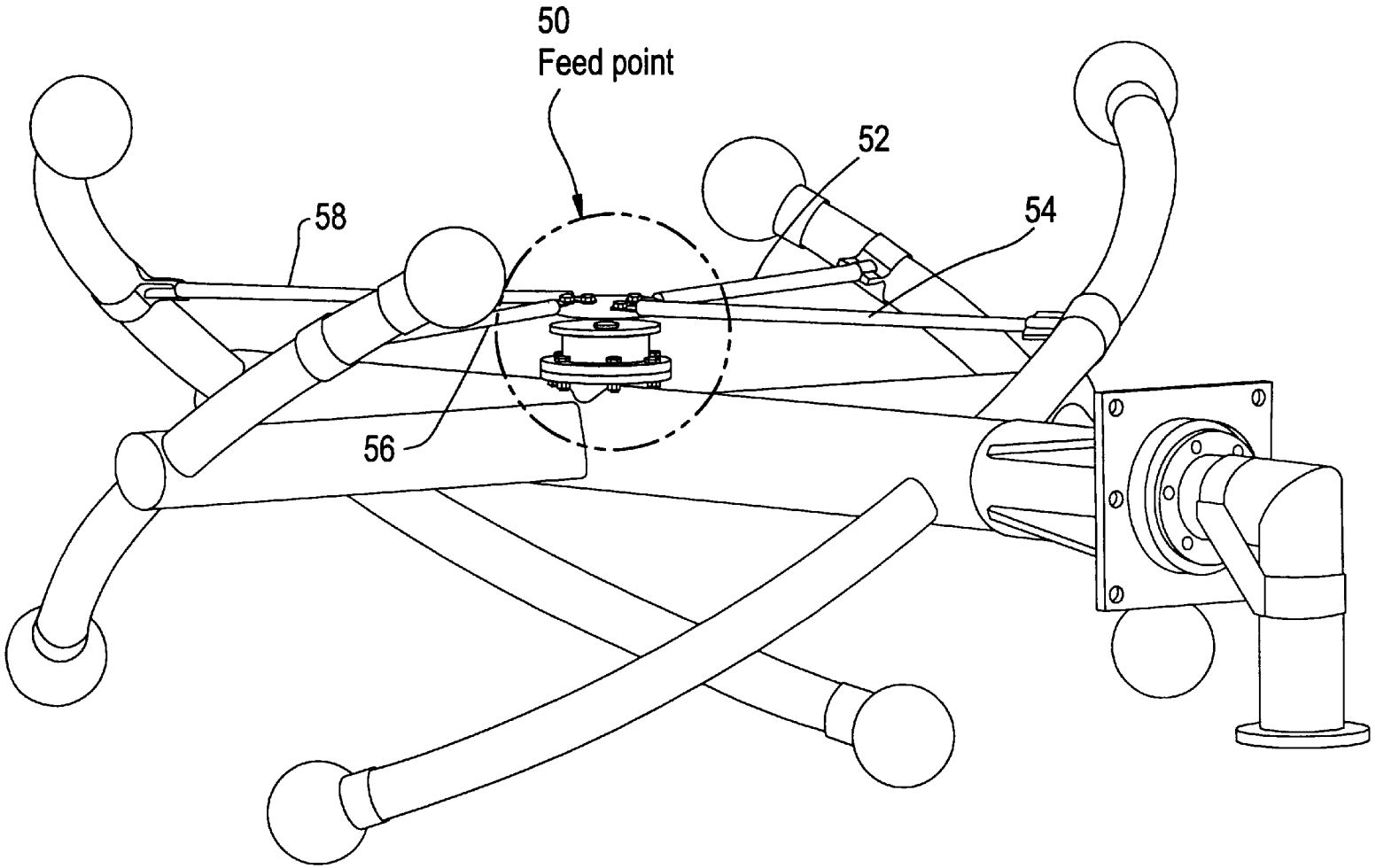
FIG. 5 illustrates the arrangement of several elements of an exemplary embodiment of the present invention.
Figure 6:
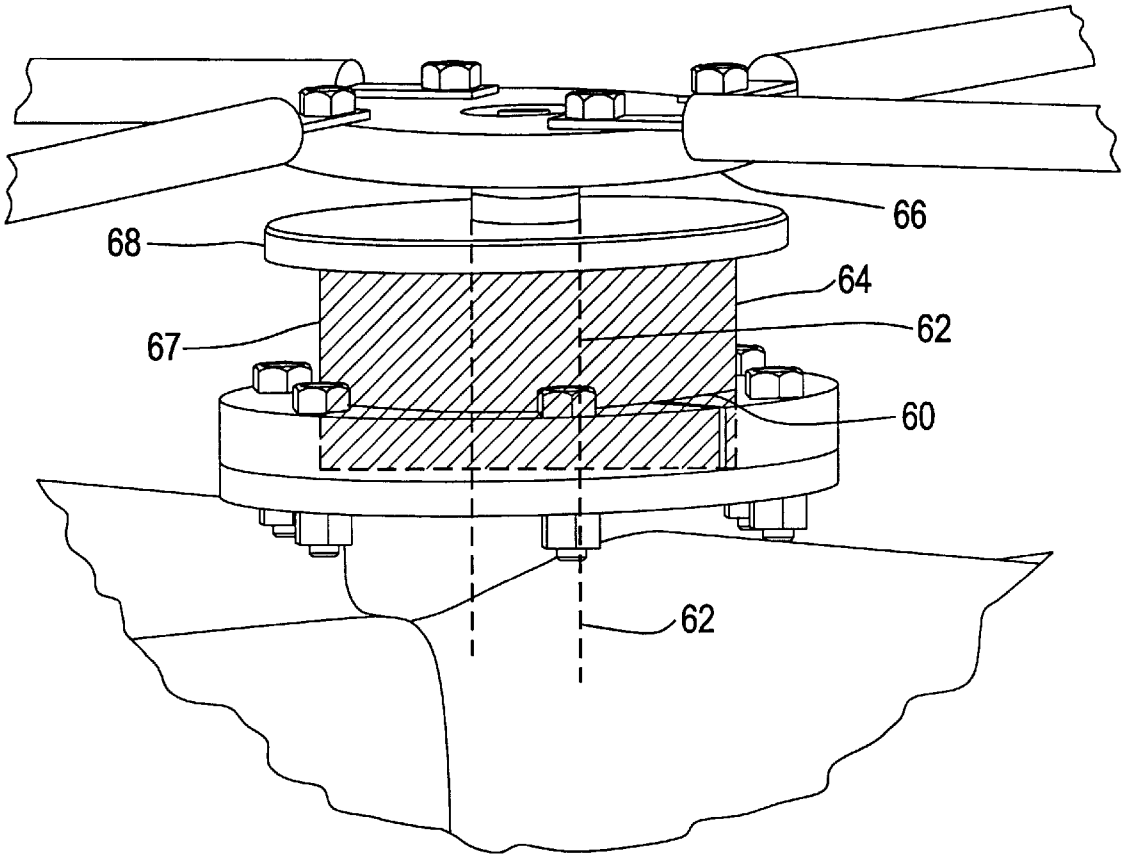
FIG. 6 illustrates the arrangement of several elements at a feed point of an exemplary a embodiment of the present invention.

In an exemplary embodiment of a quadrapole FM antenna system 10 according to the present invention, a feed point 50 is provided. As shown in FIG. 5, feed arms 52, 54, 56 and 58 extend from each of the dipole members and terminate at the feed point. As shown in FIG. 6, the feed point includes a feed point mouth 60 that is 3 inches in diameter. The designated size of the feed point mouth is designed to accommodate high power operations. However, the size of the feed point mouth may be less than or greater than 3 inches in diameter. Further, as shown in FIG. 6, the FM antenna, according to an exemplary embodiment of the present invention, includes an inner conductor 62 that is surrounded, at least partially, by an outer conductor 64. The feed point outer conductor 64 may be utilized as a coaxial outer conductor for the energy traveling through the feed. In an exemplary embodiment of the present invention, the outer conductor 64 has the same diameter as the feed point mouth. Thus, in an exemplary embodiment, the diameter of the outer conductor 64 may be 3 inches. However, the diameter of the outer conductor 64 may be less than or greater than 3 inches in diameter. The feed point mouth 60 also includes a feed point tap disk 66. The feed point tap disk 66 is coupled to the inner conductor 62 and the feed arms 52, 54, 56 and 58. The feed point tap disk 66 causes the feed point energy, to each of the four dipole members, to be equally distributed. Further, the feed point tap disk acts as an impedance transformer to match the impedance of the transmission line to the impedance of the feed point mouth 60. Further, because of the size of the feed point tap disk 66, the current handling capability at the end of the inner conductor 62 is improved. Thus, the power handling of the antenna 10 is increased overall.

Additionally, as shown in FIG. 6, a gas stop 67, which may be made of Teflon or any other suitable material, is formed near the inner conductor 62. Low dielectric, non-conductive materials, such as Teflon, are examples of suitable materials to use for the gas stop. The gas stop may be utilized as a pressure seal that does not affect the transmission characteristics of the energy at the feed point. The gas stop may also help to keep contaminates out of a broadcast antenna system. The gas stop includes a portion 68, which may be referred to as a "drip lip", that is larger in diameter than the outer conductor 64. The shape of this portion eliminates the possibility of water, ice, or other substances from dripping from the feed point tap disk 66 to the outer conductor 64. This portion 68, which may be referred to as a "drip lip", increases a path length for water, ice or other substances to travel, such that moisture from the inner conductor to the outer conductor is avoided. The drip lip 68, as a result, prevents breakdown in the operation of the antenna.

The many features and advantages of the invention are apparent from the detailed specification, and thus, it is intended by the appended claims to cover all such features and advantages of the invention which fall within the true spirits and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. An antenna system, comprising:

a first curved dipole member;

a first connecting member, wherein said first curved dipole is affixed to one end of the first connecting member wherein said first dipole members forms a straight line between its terminal ends when viewed along the axis of the first connecting member;

a second curved dipole member;

a second connecting dipole member, wherein said second curved dipole member is affixed to one end of said second connecting member, and wherein said second dipole member forms a straight line between its terminal ends when viewed along the axis of the second connecting member, wherein said second connecting member intersects said first connecting member, and wherein a first angle between said straight line formed by said first curved dipole member and said second connecting member different from a second angle between said straight line formed by said second curved dipole member and said axis of said first connecting member.

2. The antenna system of claim 1, wherein said first angle is less than 40° and wherein said second angle is less than 30°.

3. The antenna system of claim 1, further comprising:

a third curved dipole member connected to the opposite end of said first connecting member from said first curved dipole member; and a fourth curved dipole member connected to the opposite end of said second connecting member from said second curved dipole member.

4. The antenna system of claim 1, wherein said first angle is 36° and wherein said second angle is 27.5°.

5. The antenna system of claim 3, wherein said third curved dipole member forms a straight line between its terminal ends when viewed along the axis of the first connecting member, wherein said fourth curved dipole member forms a straight line between its terminal ends when viewed along the axis of the second connecting member, and wherein there is a third angle between said straight line formed by said third curved dipole member and said second connecting member that is equal to said first angle a fourth angle between said straight line formed by said fourth curved dipole member and said axis of said first connecting member that is equal to said second angle.

6. The antenna system of claim 5, wherein said third angle is less than 40° and, wherein said fourth angle is less than 30°.

7. The antenna system of claim 1, wherein a first length of said first connecting member between said first and said third curved dipole member and a second length of said second connecting member between said second and said fourth curved dipole members is greater than 40 inches.

8. The antenna system of claim 7, wherein said length greater than 40 inches is 45 inches.

9. An antenna comprising:

a first curved dipole means;

a first connecting means, wherein said first curved dipole means is affixed to one end of the first connecting means wherein said first curved dipole means forms a straight line between its terminal ends when viewed along the axis of the first connecting means;

a second curved dipole means;

a second connecting dipole means, wherein said second curved dipole means is affixed to one end of said second connecting means, and wherein said second curved dipole means forms a straight line between its terminal ends when viewed along the axis of the second connecting means, wherein said second connecting means intersects said first connecting means, and wherein a first angle between said straight line formed by said first curved dipole means and said second connecting means is different from a second angle between said straight line formed by said second curved dipole means and said axis of said first connecting means.

10. The antenna of claim 9, wherein said first angle is less than 40° and wherein said second angle is less than 30°.

11. The antenna of claim 9, further comprising:

a third curved dipole means connected to the opposite end of said first connecting means from said first curved dipole means; and a fourth curved dipole means connected to the opposite end of said second connecting means from said second curved dipole means.

12. The antenna of claim 10, wherein said angle less than 40° is 36° and wherein said angle less than 30° is 27.5°.

13. The antenna of claim 11, wherein said third curved dipole means forms a straight line between its terminal ends when viewed along the axis of the first connecting means;

wherein said fourth curved dipole means forms a straight line between its terminal ends when viewed along the axis of the second connecting means, and wherein there is a third angle between said straight line formed by said third curved dipole means and said second connecting means that is equal to the first angle a fourth angle between said straight line formed by said fourth curved dipole means and said axis of said first connecting means that is equal to said second angle.

14. The antenna of claim 13, wherein said third angle is less than 40° and wherein said fourth angle is less than 30°.

15. The antenna of claim 9, wherein a first length of said first connecting means between said first and said third dipole means and a second length of said second connecting means between said second and said fourth curved dipole means is greater than 40 inches.

16. The antenna of claim 15, wherein said length greater than 40 inches is 45 inches.

17. A method of transmitting radio frequency signals, comprising the steps of:

transmitting a radio frequency signal to a quadrapole ring antenna; and radiating said radio frequency signal from said antenna;

wherein said quadrapole ring antenna has a first and second dipole member affixed at opposite ends of a first connecting member and wherein said first and second dipole members form straight lines between their terminal ends when viewed along the axis of the first connecting member and wherein said quadrapole ring antenna has a third and a fourth dipole member affixed at opposite ends of a second connecting member and wherein said third and fourth dipole members form straight lines between their terminal ends when viewed along the axis of the second connecting member and wherein said second connecting member intersects said first connecting member, and wherein a first angle between said straight line formed by said first dipole member and said second connecting member is different from a second angle between said straight line formed by said third dipole member and said axis of said first connecting member.

18. The method of claim 17, wherein said first angle is less than 40° and said second angle is less than 30°.

19. The method of claim 17, wherein said first angle is 36° and said second angle is 27.5°.

20. An antenna apparatus, comprising:

a first feed arm connected to a first curved dipole member;

a second feed arm connected to a second curved dipole member;

a third feed arm connected to a third curved dipole member;

a fourth feed arm connected to a fourth curved dipole member; and a feed point tap disk, wherein said first feed arm, said second feed arm, said third feed arm and said fourth feed arm terminate at said feed point tap disk.

21. The antenna apparatus of claim 20, further comprising:

an inner conductor, wherein the inner conductor is coupled to the feed point tap disk;

an outer conductor, wherein the outer conductor surrounds a portion of the inner conductor; and a gas stop, wherein the gas stop is positioned within the outer conductor and surrounds the portion of the inner conductor.

22. An antenna system, comprising:

a first curved dipole member;

a first connecting member, wherein said first curved dipole is affixed to one end of the first connecting member wherein said first curved dipole member forms a straight line between its terminal ends when viewed along the axis of the first connecting member;

a second curved dipole member;

a second connecting dipole member, wherein said second curved dipole member is affixed to one end of said second connecting member, and wherein said second curved dipole member forms a straight line between its terminal ends when viewed along the axis of the second connecting member, wherein said second connecting member intersects said first connecting member, and wherein a shortest distance between a first point located on the first curved dipole member and a second point located on the second curved dipole member is different from the shortest distance between a third point located on the first curved dipole member and a fourth point located on the second curved dipole member.

* * * * *